US008880413B2

(12) United States Patent
Virette et al.

(10) Patent No.: US 8,880,413 B2
(45) **Date of Patent: *Nov. 4, 2014**

(54) BINAURAL SPATIALIZATION OF COMPRESSION-ENCODED SOUND DATA UTILIZING PHASE SHIFT AND DELAY APPLIED TO EACH SUBBAND

(75) Inventors: David Virette, Pleumeur (FR); Alexandre Guerin, Rennes (FR)

(73) Assignee: Orange, Paris (FR)

( * ) Notice: Subject to any disclaimer, the term of this patent is extended or adjusted under 35 U.S.C. 154(b) by 873 days.

This patent is subject to a terminal disclaimer.

(21) Appl. No.: 12/309,074

(22) PCT Filed: Jun. 19, 2007

(86) PCT No.: PCT/FR2007/051457

§ 371 (c)(1),
(2), (4) Date: Jan. 6, 2009

(87) PCT Pub. No.: WO2008/003881

PCT Pub. Date: Jan. 10, 2008

(65) Prior Publication Data

US 2009/0292544 A1 Nov. 26, 2009

(30) Foreign Application Priority Data

Jul. 7, 2006 (FR) ..... 06 06212

(51) Int. Cl.

| | |
|---|---|
| ***G10L 19/00*** | (2013.01) |
| ***H04R 5/00*** | (2006.01) |
| ***H04S 3/00*** | (2006.01) |
| ***H04S 3/02*** | (2006.01) |
| ***G10L 19/008*** | (2013.01) |
| *H04S 1/00* | (2006.01) |

(52) U.S. Cl.

CPC . *H04S 3/004* (2013.01); *H04S 3/02* (2013.01); *H04S 1/002* (2013.01); *G10L 19/008* (2013.01); *H04S 3/002* (2013.01); *H04S 2400/01* (2013.01); *H04S 2420/04* (2013.01); *H04S 2420/03* (2013.01)

USPC ..... 704/501; 381/22; 381/17

(58) Field of Classification Search

CPC ..... G10L 19/008; H04S 3/02; H04S 1/002
USPC ..... 704/501; 381/22
See application file for complete search history.

(56) References Cited

U.S. PATENT DOCUMENTS 6,714,652 B1 * 3/2004 Davis et al. ..... 381/17
2005/0047618 A1 3/2005 Davis et al.

(Continued)

FOREIGN PATENT DOCUMENTS

WO WO 2004/028204 4/2004
WO WO 2005/101370 10/2005

OTHER PUBLICATIONS

Breebaart et al., "MPEG Spatial Audio Coding / MPEG Surround: Overview and Current Status", Audio Engineering Society Convention Paper, Presented at the 119th Convention, Oct. 2005.

(Continued)

*Primary Examiner* — Farzad Kazeminezhad
(74) *Attorney, Agent, or Firm* — Knobbe Martens Olson & Bear LLP

(57) ABSTRACT

The invention is aimed at improving the quality of the filtering by transfer functions of HRTF type of signals (L, R) compressed in a transformed domain, for binaural playing on two channels (L-BIN, R-BIN), using a combination of HRTF filters ($h_{L,L}$, $h_{L,R}$) including a decorrelated version (HRTF-C*, HRTF-E*) of a few of these filters. For this purpose, a decorrelation cue is given with spatialization parameters (SPAT) accompanying the compressed signals (L, R). The Decorrelation comprises applying a different phase shift to each subband of the input signal combined with addition of an overall delay. The invention makes it possible to improve the broadening in the binaural rendition of audio scenes initially in a multi-channel format.

8 Claims, 5 Drawing Sheets

(56) References Cited

U.S. PATENT DOCUMENTS

| | | | | |
|---|---|---|---|---|
| 2007/0160218 | A1* | 7/2007 | Jakka et al. | 381/22 |
| 2007/0213990 | A1* | 9/2007 | Moon et al. | 704/500 |

OTHER PUBLICATIONS

International Standard ISO/IEC 23003-1, Information technology—MPEG audio technologies—Part 1: MPEG Surround, 1st Ed, Chap. 6.6, pp. 133-137. Feb. 15, 2007. Switzerland: ISO Copyright Office.

* cited by examiner

BINAURAL SPATIALIZATION OF COMPRESSION-ENCODED SOUND DATA UTILIZING PHASE SHIFT AND DELAY APPLIED TO EACH SUBBAND

This application is a 35 U.S.C. §371 National Stage entry of International Patent Application No. PCT/FR2007/051457, filed on Jun. 19, 2007, and claims priority to French Application No. FR 0606212, filed on Jul. 7, 2006, both of which are hereby incorporated by reference in their entireties.

The invention relates to the processing of sound data for the purpose of spatialized sound playing.

The three-dimensional spatialization (called "3D rendition") of compressed audio signals takes place in particular during the decompression of a 3D audio signal, for example compression-encoded and represented on a certain number of channels, onto a different number of channels (two for example in order to allow playing 3D audio effects on a headset).

The term "binaural" means playing on a stereophonic headset a sound signal which nevertheless has spatialization effects. The invention is not however limited to the aforesaid technique and applies, in particular, to techniques derived from "binaural", such as the techniques of playing sound called TRANSAURAL (registered trademark), i.e. on distant loud speakers. Such techniques can then use "cross-talk cancellation", which consists in cancelling crossed acoustic channels, such that a sound thus processed and then emitted by the loud speakers can be perceived by only one of the two ears of a listener. These two techniques of playing sound, binaural and transaural, will be denoted below by the same terms "binaural sound restitution".

Thus, more generally, the invention relates to the transmission of multi-channel audio signals and to their conversion for a spatialized sound restitution (with 3D rendition) on two channels. The restitution device (simple headset with earphones for example) is most often imposed by a user's equipment. The conversion can for example be for the purpose of sound restitution of a scene initially in the 5.1 multi-channel format (or 7.1, or another) by a simple audio listening headset (in binaural technique).

The invention also of course relates to the restitution, in the context of a game or of a video recording for example, of one or more sound samples stored in files, in order to spatialize them.

Among the techniques known in the field of binaural sound spatialization, different approaches have been proposed.

Figure 1:
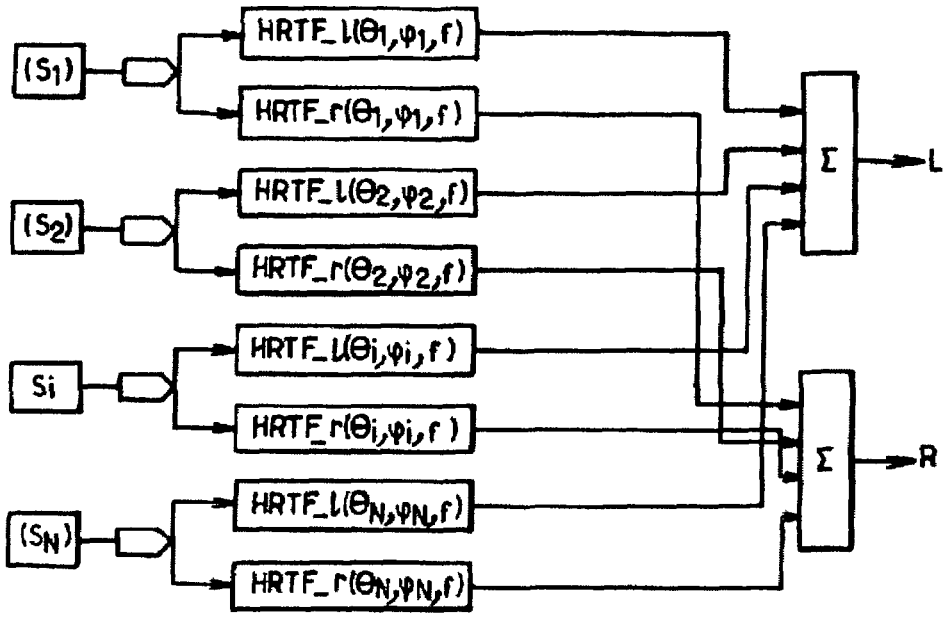
FIG.1. (PRIOR ART)

In particular, dual-channel binaural synthesis consists, with reference to FIG. 1 relating to the prior art, in:

- associating a position in space with each sound source $S_i$ (or each channel of the multi-channel signal),
- filtering these sources in the frequency domain by the left HRTF-l and right HRTF-r acoustic transfer functions corresponding to the chosen direction (or to the chosen position), and defined by their polar coordinates $(\theta_1, \phi_1)$.

These transfer functions, commonly called "HRTF" functions (Head Related Transfer Functions), represent the acoustic transfer between the positions in space and the auditory canal of each of the listener's ears. The term "HRIR" (for "Head Related Impulse Response") refers to their temporal form or impulse response. These HRIR functions can furthermore include a room effect.

For each sound source $S_i$, two signals (left and right) are obtained which are then added to the left and right signals resulting from the spatialization of all the other sound sources, in order to produce finally the signals L and R which are delivered to the left and right ears of the listener through two respective loud speakers (earphones of a headset in binaural technique or loud speakers in transaural technique).

If N denotes the number of incident sound or audio flux sources to be spatialized, the number of filters, or transfer functions, necessary for the binaural synthesis is 2×N for a rendition in static binaural spatialization, and 4×N for a rendition in dynamic binaural spatialization (with transitions of the transfer functions).

The processing described above with reference to FIG. 1 and making use of HRTF transfer functions is conventional. It is often used for a 3D rendition from two loud speakers. It can be the basis of an embodiment used by the present invention, as will be seen below. It is in this context that it is introduced here.

Nevertheless, the invention starts from another type of prior art.

Figure 2A:
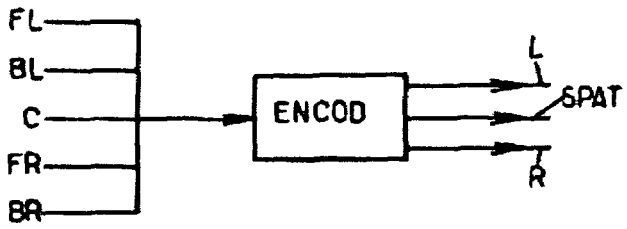
Figure 2B:
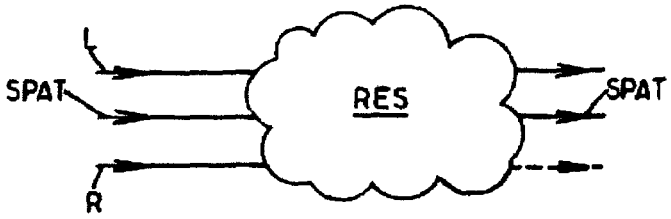

There are compression techniques, often in a transformed domain, of signals in a multi-channel format in order to be able to convey these signals, in particular through telecommunication networks, on a restricted number of channels, for example on only one or two channels. Thus, for the transmission of a signal in a multi-channel format comprising more than two channels (for example 5.1, 7.1 or other), an encoder compresses the multi-channel signal on only one or two channels (typically according to the data rate offered on the telecommunications network) and furthermore delivers spatialization information. This embodiment is shown in FIG. 2A where, as an example for a signal in a 5.1 multi-channel format, five channels (C for a central loud speaker, FL of a front left loud speaker, FR for a front right loud speaker, BL for a back left loud speaker and BR for a back right loud speaker) are compression-encoded by a module ENCOD able to deliver two compressed channels L and R, as well as spatialization information SPAT. The compressed channels L and R, as well as the spatialization information SPAT are then routed through one or more telecommunication networks RES, on one or two channels according to the data rate offered (FIG. 2B).

Figure 2C:
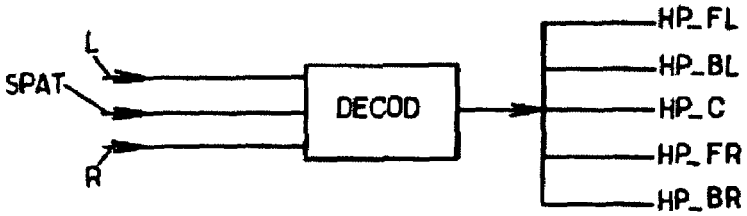

With reference to FIG. 2C, on reception of the compressed signal on the two channels L and R, a decoder (DECOD) reconstitutes the original signal in the initial multi-channel format thanks to the spatialization information SPAT delivered by the encoder and, in the example of the FIGS. 2A and 2C, five channels are again found, after decoding, feeding five loud speakers (HP-FL, HP-FR, HP-C, HP-BL and HP-BR) for a restitution in the 5.1 format.

Many types of parametric encoders/decoders, in particular standardized ones, offer such possibilities.

Audio encoders (AAC, MP3) use time-frequency representations of signals for compressing the information. These representations are based on an analysis by banks of filters or by time-frequency transformation of the MDCT (Modified Discrete Cosine Transform) type. In the case where a binaural spatialization must be carried out after an audio decoding, the filtering operations are advantageously carried out directly in the transformed domain.

Recent work on filtering subbands in the transformed domain has made it possible to formalize the filtering architecture for a bank of filters commonly used in audio encoders. It will be useful to refer to the document:

"*A Generic Framework for Filtering in Subband Domain*", A. Benjelloun Touimi, IEEE Proceedings—9th Workshop on Digital Signal Processing, Hunt, Tex., USA, October 2000.

A more recent transformed domain filtering technique of complex QMFs (Quadrature Mirror Filters) has been proposed in the "MPEG Surround" standard. This technique aims at the conversion of the impulse response (finite) of the temporal filter referenced h(v) in a set of M complex filters referenced $h_m(l)$, where M is the number of subbands of frequencies. The conversion is carried out by analysis of the temporal filter h(v) by a bank of complex filters similar to the bank of QMF filters used for the analysis of the signal. In an example of embodiment, the prototype filter q(v) used for generating the conversion filter bank can be of length 192. An extension with zeros of the temporal filter is defined by the following formula:

$$\tilde{h}(v) = \begin{cases} h(v), & v = 0, 1, \ldots, N_h - 1; \\ 0, & \text{otherwise,} \end{cases}$$

where $N_h$ is the length of the filter in the time domain, $L_q = K_h + 2$, where $K_h = [N_h/64]$, the length of the filter in subbands (for 64 subbands).

The conversion is therefore given by the following formula:

$$h_m(l) = \sum_{v=0}^{191} \tilde{h}(v + 64(l-2))q(v)\exp\left(-j\frac{\pi}{64}\left(m + \frac{1}{2}\right)(v - 95)\right)$$

with:

m=0.1 . . . , 63, corresponding to the index of the subband l=0.1 . . . , $K_h$+1, corresponding to the temporal index in the decimated domain of the subbands.

In more generic terms, it will be understood that such processing, directly in the transformed domain, makes it possible to change from a representation of the compressed signal on two channels L, R into a representation of the signal on two restitution channels L-BIN, R-BIN (FIG. 3) with a binaural or transaural broadening. For this purpose, a transcoding is provided (module DECOD BIN in FIG. 3) which is based on an approach consisting in reconstituting, from the compressed signals L, R and from spatialization information SPAT, the transfer functions, of the HRTF type, between one ear of a listener and each (virtual) loud speaker which would have been fed by a given channel of the initial multi-channel format.

Figure 3:
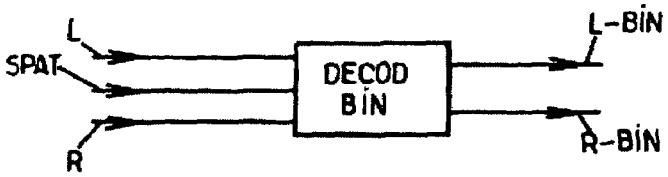
Figure 4:
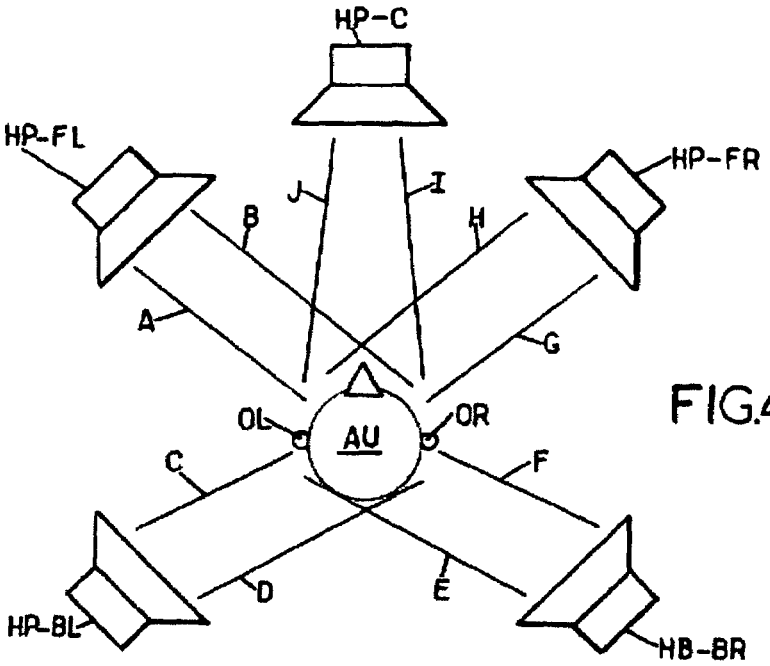

Thus, now referring to FIG. 4 illustrating a "virtual" restitution with the 5.1 format, and therefore from five loud speakers, the transcoding used by the DECOD BIN module in FIG. 3 must consider ten transfer functions:

- one for path A between the front left loud speaker HP-FL and the left ear OL of the listener AU,
- one for path B between the front left loud speaker HP-FL and the right ear OR of the listener AU,
- one for path C between the back left loud speaker HP-BL and the left ear OL of the listener AU,
- one for path D between the back left loud speaker HP-BL and the right ear OR of the listener AU,
- one for path G between the front right loud speaker HP-FR and the left ear OR of the listener AU,
- one for path H between the front right loud speaker HP-FR and the left ear OL of the listener AU,
- one for path F between the back right loud speaker HP-BR and the right ear OR of the listener AU,
- one for path E between the back right loud speaker HP-BR and the left ear OL of the listener AU,
- one for path J between the central load speaker HP-C and the left ear OL of the listener AU, and
- one for path I between the central loud speaker HP-C and the right ear OR.

Thus, the subband filters in the transformed domain are calculated for each ear and for each of the five positions of the loud speakers. This technique is often called the "virtual loud speakers technique".

Using the representation in subbands of the binaural filters determined as described above from HRTF transfer functions, the binaural spatialization can then be advantageously carried out by applying these binaural filters in the transformed domain within the audio decoder DECOD BIN such as shown in FIG. 3.

Thus, this type of decoder DECOD BIN uses a monophonic or stereophonic representation (compressed channels L, R) of the multi-channel audio scene, a representation with which are associated spatialization parameters SPAT (which can consist, for example, in energy differences between channels and correlation indices between channels). These SPAT parameters are used in the decoding on order to reproduce the original multi-channel sound scene as well as possible.

Moreover, when the original signal is encoded by a parametric encoder (for example in the sense of recent work in the "MPEG Surround" standard), in addition to the monophonic or stereophonic signal transmitted and spatialization information, the decoding can use decorrelated representations of these signals L, R (which are obtained, for example, by the application of all-pass decorrelation filters or reverberation filters). These signals are then adjusted in energy using the inter-channel energy differences and then recombined in order to obtain the multi-channel signal for the purpose of restitution.

In particular, the parametric encoder (ENCOD—FIG. 2A) of the multi-channel format into two compressed channels (stereo or mono) format according to the draft "MPEG Surround" standard delivers a decorrelation between channels cue in the initial multi-channel format and this decorrelation cue can be used again by the standard parametric decoder (DECOD—FIG. 2C) during the restitution in the initial multi-channel format.

A description of preparatory work for this standard is given at the following URL address:

www.chiariglione.org/mpeg/technologies/mpd-mps/index.htm and details regarding such an encoder according to this draft can be found in:

"MPEG Spatial Audio Coding/MPEG Surround: Overview and Current Status", J. Breebaart et al., in 119th Cony. Aud. Eng. Soc (AES), New York, N.Y., USA, October 2005.

In the case of a parametric audio decoder for binaural restitution (DECOD BIN—FIG. 3), it is advantageously possible to simplify the filtering operations by combining the front and back filters corresponding to the various left loud speakers (an equivalent processing also being applied for the right loud speakers). This combination is carried out according to the target energies of the audio channels given by the spatialization parameters. This combination, for the left ear and the front left and back left channels, is carried out in the transformed domain according to an expression (1) of the following type:

$$h_{L,L} = g_{L,L}\sigma_{FL}\exp(-j\phi_{FL,BL}{}^{L}\sigma_{BL}{}^{2})h_{L,FL} + g_{L,L}\sigma_{BL}\exp(j\phi_{FL,BL}{}^{L}\sigma_{FL}{}^{2})h_{L,BL}$$

In this Expression:

- $h_{LL}$ is the filter corresponding to the front left and back left channels,
- $g_{LL}$ is the gain associated with all of the left channels,
- $\sigma^2_{FL}$ and $\sigma^2_{BL}$ are the useful energies of the front left and back left channels respectively, $h_{L,FL}$ and $h_{L,BL}$ are the transfer functions in the subband domain between the left ear and the front left and back left loud speakers respectively (paths A and C in FIG. 4), $\phi^{L}_{FL,BL}$ is the phase shift corresponding to the delay between the front left and back left temporal filters $h_{L,FL}$ and $h_{L,BL}$.

The purpose of this phase compensation, depending on the target energy of the channels, is to avoid an effect called "colouration" resulting from the addition of two filters offset in time (comb filtering).

Figure 5A:
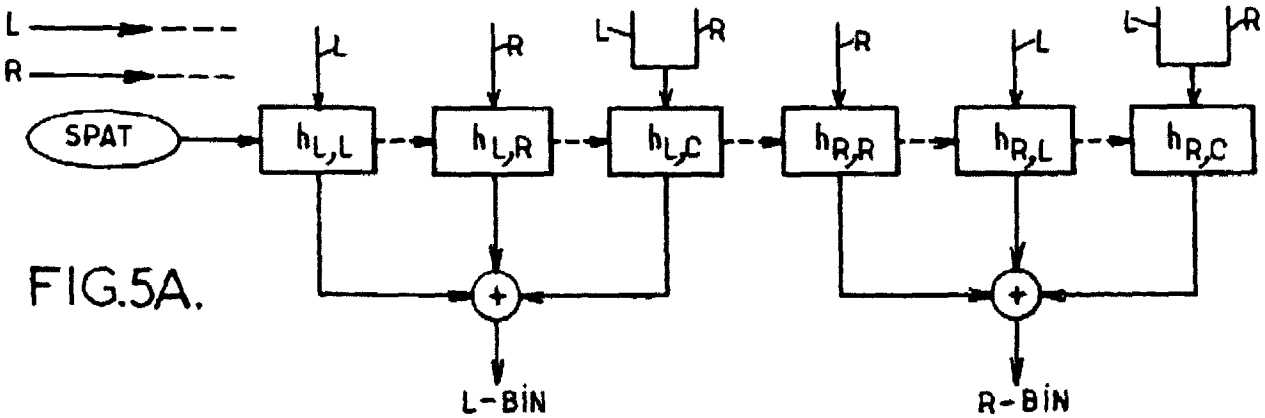

With reference to FIG. 5A, a decoder receives the spatialization parameters SPAT accompanying the compressed signals on two channels L and R in the example shown and, in this same FIG. 5A, it has been illustrated how the aforesaid filter $h_{L,L}$ is applied to the compressed channel L in order to form a component of the signal L-BIN, intended for the binaural restitution. However, as also shown in FIG. 5A, it is appropriate also to take account of the compressed signal on channel R, with must itself be filtered by a filter making use of HRTF transfer functions (referenced $h_{L,FR}$ and $h_{L,BR}$) relating to the crossed channels H and E in FIG. 4, still towards the left ear. The filter corresponding to these crossed paths (referenced $h_{L,R}$) is calculated as a function of the gains, target energies and phase shifts, taken from the spatialization parameters SPAT, using an expression equivalent to equation (1) given above. This filter $h_{L,R}$ is finally applied to the compressed signal on channel R. It is appropriate to also take account of the "contribution" of the central loud speaker in the construction of the signal intended for the binaural restitution L-BIN and, in order to do this, a filter $h_{L,C}$ (FIG. 5A) is applied to a combination (for example by addition) of the compressed signals of the L and R channels in order to take account here of the path J towards the left ear OL in FIG. 4.

With reference the FIG. 5A again, an equivalent processing is provided for the construction of the R-BIN signal intended for a binaural restitution for the right ear OD, with three contributions given by:

- the compressed signal on channel R filtered by the filter $h_{R,R}$ representing the HRTF functions of the right loud speakers (direct paths G and F in FIG. 4);
- the compressed signal on channel L filtered by the filter $h_{R,L}$ representing the HRTF functions of the left loud speakers (crossed paths B and D in FIG. 4); and
- a combination of the compressed signals L and R filtered by the filter $h_{R,C}$ representing the HRTF functions of the central loud speaker (direct path I in FIG. 4).

Figure 5B:
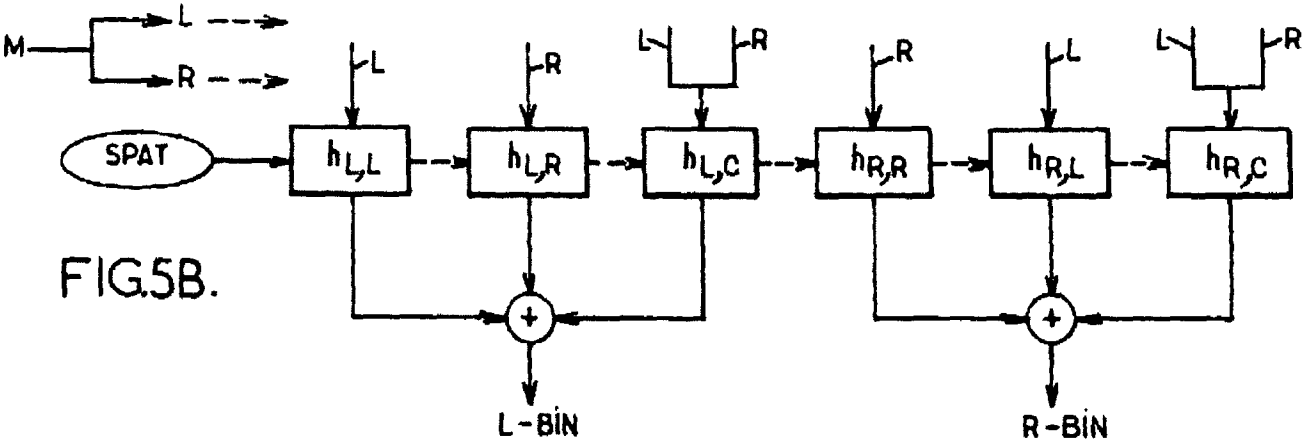

In FIG. 5B, another example has been shown in which a decoder receives the compressed signal on a single channel M, accompanying the spatialization parameters SPAT. In the example shown, the channel M is duplicated into two channels L and R and the rest of the processing is strictly equivalent to the processing shown in FIG. 5A.

The two signals L-BIN and R-BIN resulting from these filterings can then be applied to two loud speakers intended for the left ear and for the right ear respectively of the listener after changing from the transformed domain to the temporal domain.

However, a problem linked with this combination of filters for a binaural restitution is that it does not take account of a possible decorrelation between the front and back channels. This information, nevertheless used in the decoding of a 5.1 scene of an encoder according to the aforesaid draft of the MPEG Surround standard, is not used in the binaural decoding technique. Thus, when the sound scene comprises decorrelation effects between the front and back channels (for example for reverberated signals), this information is not used in the combination of HRTF filters, which results in a degradation of the spatialization quality and in particular of the surround effect of the 3D audio scene. The restitution in the binaural format is not therefore optimal.

The present invention has improved the situation.

It firstly relates to a method of processing sound data for a three-dimensional spatialized restitution on two restitution channels for the respective ears of a listener, the sound data being initially represented in a multi-channel format and then compression-encoded on a reduced number of channels (for example one or two channels), said initial multi-channel format consisting in providing more than two channels able to feed respective loud speakers, the method comprising the steps:

- obtaining spatialization parameters with the compressed data on said reduced number of channels,
- for each restitution channel associated with an ear of the listener, forming, on the basis of said spatialization parameters, a combination of filters each representing transfer functions between that ear of the listener and loud speakers that could be fed by respective channels of the initial multi-channel format, and
- applying the combination of filters associated with each restitution channel to the compressed data.

The method according to the invention furthermore comprises the following steps:

- for each restitution channel associated with an ear of the listener, determining from said spatialization parameters at least one transfer function of a loud speaker situated behind the listener's ear and representing a decorrelation between the channels of the multi-channel format respectively associated with the back loud speaker and at least one loudspeaker situated in front of the listener's ear, and
- for each restitution channel, integrating said transfer function representing a decorrelation in said combination of filters associated with this restitution channel.

The spatialized restitution on two channels, according to the invention, can be in either the binaural or transaural format. The initial multi-channel format can be of the ambisonic type (aimed at the decomposition of the sound signal on a spherical harmonics basis). As a variant, it can be a 5.1 or 7.1 or even 10.2 format. It will therefore be understood that for these latter types of format using channels intended to respectively feed at least front left/back left pairs of loud speakers on the one hand and front right/back right pairs of loud speakers on the other hand, the decorrelation cue can relate to the respective channels of the front/back loud speakers preferably associated with a same ear (left or right).

According to one advantage provided by the invention, because this decorrelation cue at the back of a 3D scene is represented in the binaural or transaural restitution, a better representation of ambiances is obtained, for example crowd noises or a reverberation at the back of a scene, or other, unlike the embodiments of the prior art.

In a particular embodiment, the combination of filters comprises a weighting, according to a coefficient chosen between:

- an unprocessed transfer function of the loud speaker situated at the back, and
- a version of the transfer function of this loud speaker, representing the decorrelation This weighting advantageously makes it possible to favour the unprocessed transfer function of this back loud speaker, or the decorrelated version of that unprocessed transfer function, depending on whether the signal in the back channel of the initial multi-channel format is correlated or not with at least one signal of one of the front channels.

Moreover, in a particular embodiment, the combination of filters associated with a restitution channel comprises at least one grouping forming a filter on the basis of:

the transfer function of a front loud speaker, the transfer function of a back loud speaker, and the transfer function representing a decorrelation between channels, and these front and back loud speakers are situated on a same side with respect to the listener. It can for example be front and back loud speakers both situated on the left (or both on the right) of the listener with the 5.1 format (such as shown in FIG. 4). In such an embodiment, when the weighting between the decorrelated version and the unprocessed version of the transfer functions is provided, it can be advantageous to favour the decorrelated version in the combination of filters of the left loud speakers for the restitution channel to the right ear (and vice-versa) and to favour the unprocessed version (not decorrelated) in the combination of filters of the right (left) loud speakers for the restitution channel to the right (left) ear.

Advantageously, the compression-encoding uses a parametric encoder delivering, in the compressed flow including the spatialization parameters, a decorrelation between channels of the multi-channel format cue, on the basis of which said weighting can be determined in a dynamic manner.

Thus, in this embodiment, for a transcoding between a multi-channel format to a binaural format, the said combination of transfer functions makes use of the cues already present concerning the correlation between signals of channels in the multi-channel format, these cues being simply provided by the parametric encoder, with the said spatialization parameters.

By way of example, it is recalled that the parametric decoder according to the draft MPEG Surround standard delivers such decorrelation between channels cues in the 5.1 multi-channel format.

Figure 6A:
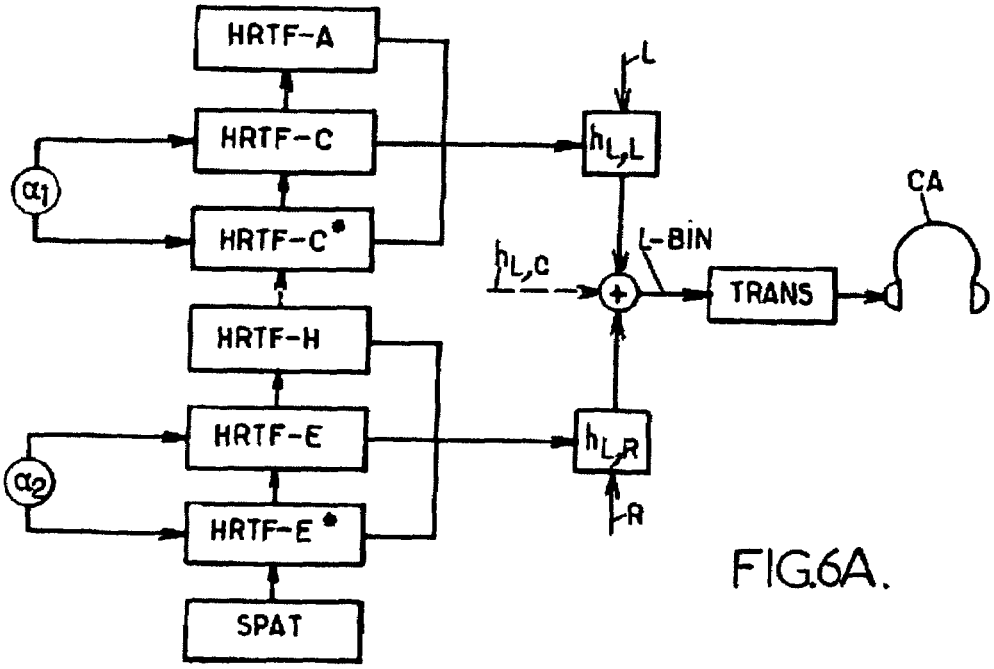
Figure 6B:
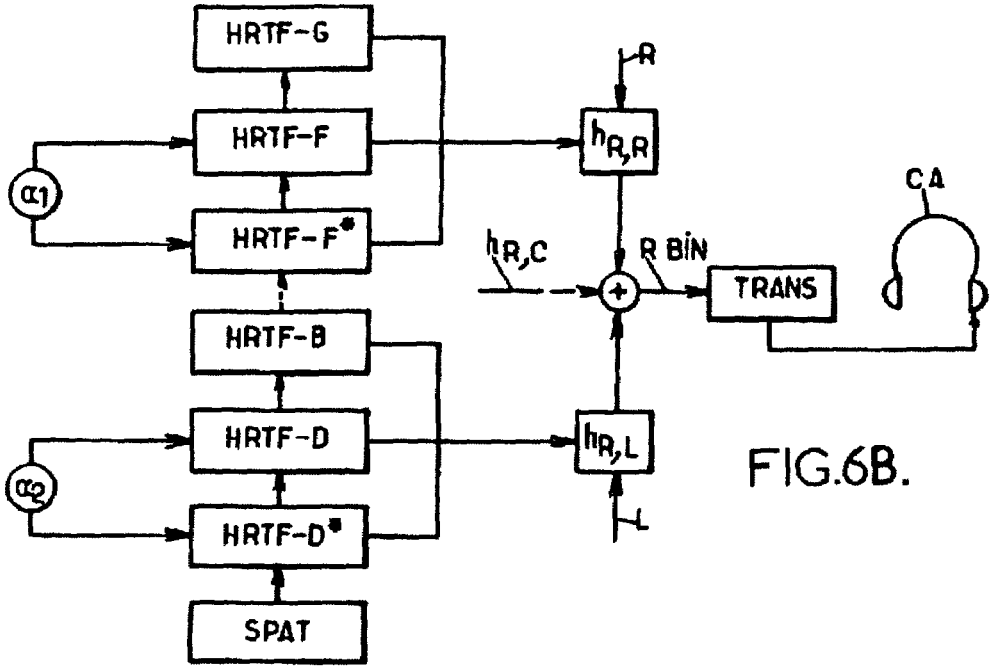
Figure 7:
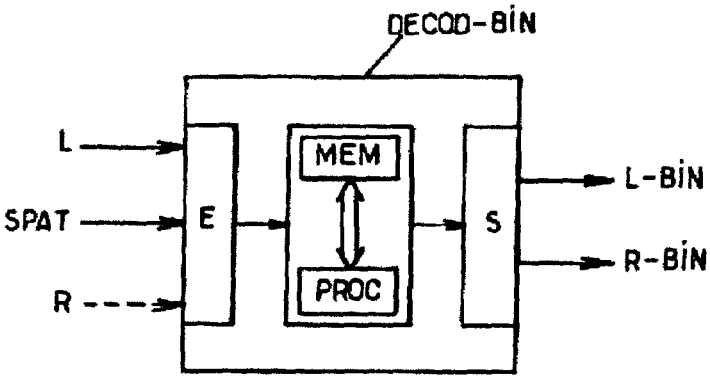

Other advantages and features of the invention will become apparent on reading the detailed description given hereafter by way of example, and on observation of the appended drawings, in which, apart from FIGS. 1, 2A, 2B, 2C, 3 and 4, 5A and 5B commented upon above:

FIGS. 6A and 6B show, by way of example, a processing by filtering of compressed data (on two channels in the example shown), the filtering being determined by the implementation of the method according to the invention in order to deliver signals L-BIN and R-BIN intended to feed the left and right channels respectively of a binaural restitution device such as a headset with two earphones, taking account of a front/back decorrelation, and FIG. 7 is a diagrammatic illustration of the structure of a module implementing the method according to the invention.

With reference to FIG. 6A, firstly the compressed signal is retrieved, often in the transformed domain, on two channels L and R in the example shown, as well as the spatialization parameters SPAT that have been provided by an encoder such as the module ENCOD in FIG. 2A described previously. From the spatialization parameters SPAT, transfer functions are determined in order to construct a combination of filters (sign "+" in FIG. 6A), each filter having to be applied to one channel, L (filter $h_{L,L}$ of FIG. 5A) or R (filter $h_{L,R}$ of FIG. 5A), or to a combination of these channels (filter $h_{L,C}$ of FIG. 5A) in order to construct a signal feeding one of the two binaural restitution channels L-BIN. These transfer functions, of HRTF type, are representative of the interference undergone by an acoustic wave on a path between a loud speaker, which would have been fed by a channel of the initial multi-channel format, and an ear of the listener. For example if the audio content is initially in the 5.1 format, such as described above with reference to FIG. 4, a total of ten HRTF transfer functions are determined, five HRTF functions for the right ear (on paths B, D, G F and I of FIG. 4) and five HRTF functions for the left ear (on paths A, C, H, E and J). It is stated that the central loud speaker is treated separately in the binaural spatialization and the obtaining of the corresponding filter $h_{L,C}$ or $h_{R,C}$ will not be described here, it being understood that it is not, a priori, involved in the subject-matter of the invention.

Thus, in general terms, the HRTF functions of front and back loud speakers on a same side of the listener are therefore grouped in order to construct each filter from a combination of filters belonging to a restitution channel to one ear of a listener. A grouping of HRTF functions in order to construct a filter is for example an addition, subject to multiplying coefficients, an example of which will be described below.

According to the invention, there is also determined from the retrieved SPAT parameters, a decorrelated version of the HRTF functions of the loud speakers situated behind the listener (paths C, D, E and F of FIG. 4) and this decorrelated version is integrated in each grouping in order to form a filter to be applied to a compressed channel.

As a purely illustrative example, the initial sound data can be in the 5.1 multi-channel format and, with reference to FIG. 6A, a first grouping comprises:

the function HRTF-A (for the front left loud speaker according to a direct path to the left ear OL shown in FIG. 4), the function HRTF-C (for the back left loud speaker according to a direct path to the left ear), and the decorrelated version of this function HRTF-C, referenced HRTF-C*, in order to form the filter to be applied to the compressed channel L.

A second grouping comprises:

the function HRTF-H (for the front right loud speaker according to a crossed path to the left ear), the function HRTF-E (for the back right loud speaker according to a crossed path), and the decorrelated version function HRTF-E, referenced HRTF-E*, in order to form the filter to be applied to the compressed channel R.

The addition of the two signals resulting from such filterings will be a component of the signal feeding the binaural restitution channel L-BIN associated with the left ear.

A similar processing is provided in order to construct the signal intended to feed the other binaural restitution channel R-BIN shown in FIG. 6B. Here, account is taken of the HRTF functions of the paths leading to the right ear OD of the listener AU (FIG. 4). A first grouping comprises the functions HRTF-G (for the front right loud speaker according to a direct path), HRTF-F (for the back right loud speaker according to a direct path) and the decorrelated version, referenced HRTF-F*, of the function HRTF-F in order to form the filter to be applied to the compressed channel R. A second grouping comprises the function HRTF-B (for the front left loud speaker according to a crossed path), the function HRTF-D (for the back left loud speaker according to a crossed path) and the decorrelated version, referenced HRTF-D*, of the function HRTF-D, in order to form the filter to be applied to the compressed channel L.

Finally, the combinations of filters integrating the decorrelated versions of the HRTF functions of the back loud speakers are applied to the compressed channels L and R in order to deliver the restitution channels L-BIN and R-BIN, for spatialized binaural restitution with 3D rendition.

In the examples shown in FIGS. 6A and 6B, the received sound data are compression-encoded on two stereophonic channels L and R as shown in the example of FIG. 5A. As a variant, they could be compression-encoded on a single monophonic channel M, as shown in FIG. 5B, in which case the combinations of filters are applied to the monophonic channel (duplicated) as shown in FIG. 5B, in order to again deliver two signals feeding the two restitution channels L-BIN and R-BIN respectively.

In an advantageous embodiment, the initial sound data are in the 5.1 multi-channel format and are compression-encoded by a parametric encoder according to the abovementioned draft MPEG Surround standard. More particularly, during such encoding, it is possible of obtain, from the spatialization parameters provided, a decorrelation cue between the back right channel and the front right channel (loud speakers HP-BR and HP-FR respectively of FIG. 4), as well as similar decorrelation cue between the back left channel and the front left channel (loud speakers HP-FR and HP-BR respectively of the FIG. 4).

These decorrelation cues, in a 5.1 format, aim to make the restitution of the back loud speakers as independent as possible from the restitution of the front loud speakers, in order to enhance, in 5.1 format, the effect of surrounding by noises of reverberation or of the audience for concert recordings for example. It is recalled that this enhancement of 3D surround has not been proposed in binaural restitution and an advantage of the invention is to benefit from the availability of decorrelation cues among the spatialization parameters SPAT in order to construct decorrelated versions of the HRTF functions which are advantageously integrated in the combinations of filters for a binaural restitution.

According to another advantage, these combinations of filters can be calculated directly in the transformed domain, for example in the subbands domain, and the filters representing the decorrelated versions of the HRTF functions of the back loud speakers can be obtained for example by applying to the initial HRTF functions a phase shift depending on the frequency subband in question.

More generally, the decorrelation filters can be so-called "natural" reverberation filters (recorded in a particular acoustic environment such as a concert hall for example), or "synthetic" reverberation filters (created by summation of multiple reflections of decreasing amplitude over time). The application of a decorrelated filter can therefore amount to applying to the signal broken down into frequency subbands a different phase shift in each of the subbands, combined with the addition of an overall delay. In the case of a parametric decoder of the aforesaid type (formula (1) given previously in the description of the prior art), this amounts to multiplying each frequency subband by a complex exponential, having a different phase in each subband. These decorrelation filters can therefore correspond to syntheses of phase-shifting all-pass filters.

Advantageously, a weighting is applied between the transfer function of a back loud speaker and its decorrelated version in a same grouping forming a filter. Thus, taking again the formula (1) given previously for the calculation of a filter, for example $h_{L,L}$ for the left ear, weighting coefficients $\alpha$ and $(1-\alpha)$ and the decorrelated version of a transfer function are introduced as follows:

$$h_{L,L}=g_{L,L}\sigma_{FL}\exp(-j\phi_{FL,BL}{}^{L}\sigma_{BL}{}^{2})h_{L,FL}+g_{L,L}\sigma_{BL}\exp(j\phi_{FL,BL}{}^{L}\sigma_{FL}{}^{2})(\alpha h_{L,BL}+(1-\alpha)h_{L,BL}{}^{Decorr})$$

with the same notations as explained previously and where $h^{Decorr}{}_{L,BL}$ represents the decorrelated version of the transfer function of the back left loud speaker. The same type of equations are of course provided giving the other filters $h_{L,R}$, $h_{R,R}$ and $h_{R,L}$ (FIGS. 5A and 5B).

For example, for the filter $h_{L,R}$ for the crossed paths to the left ear, the expression is:

$$h_{L,R}=g_{L,R}\sigma_{FR}\exp(-j\phi_{FR,BR}{}^{L}\sigma_{BR}{}^{2})h_{L,FR}+g_{L,R}\sigma_{BR}\exp(j\phi_{FR,BR}{}^{L}\sigma_{FR}{}^{2})(\alpha h_{L,BR}+(1-\alpha)h_{L,BR}{}^{Decorr})$$

More specifically, a weighting is provided by different coefficients $\alpha_1$ $(1-\alpha_1)$ and $\alpha_2$, $(1-\alpha_2)$ depending on whether the back loud speaker is on the same side as the ear in question ($\alpha=\alpha_1$ giving the filters $H_{L,L}$ and $h_{,R,R}$) or not ($\alpha=\alpha_2$ giving the filters $H_{L,R}$ and $h_{R,L}$). Preferentially, the decorrelated version is favoured for the crossed paths (back right loud speaker for the left ear and back left loud speaker of the right ear), such that in general the coefficient $\alpha_1$ will often be able to be greater than the coefficient $\alpha_2$.

In practice, the coefficients $\alpha$ ($\alpha_1$ or $\alpha_2$) are given by variable weighting functions in such a way as to dynamically favour the unprocessed version of the HRTF function of the back loud speaker or its decorrelated version depending on whether or not the back signal is correlated with the front signal. A better representation of ambiances (crowd noise, reverberation or other) is thus obtained in the 3D rendition.

The weighting function a can be defined dynamically because of the decorrelation cue provided with the spatialization parameters in the following way, given as a non-limitative example:

$$\alpha=\mathrm{sqrt}(abs(ICC_L)),\ \text{if } abs(ICC_L)>\sigma_{BL}{}^{2}$$

$$\sigma=\mathrm{sqrt}(\sigma_{BL}{}^{2}),\ \text{otherwise},$$

where the notation "sqrt" refers to the "square root" function, the notation "abs" refers to the "absolute value" function and the term $ICC_L$ represents the decorrelation cue (otherwise called the "correlation index") between the front channel and the back channel on the same left side and is part of the spatialization parameters transmitted by the encoder according to the draft MPEG Surround standard mentioned above. As described above, the term $\sigma_{BL}$ represents the target energy of the back left channel when it is a matter of determining the coefficient $\alpha$ in order to calculate the filter $h_{L,L}(\alpha=\alpha_1)$. An equivalent expression can of course be applied in order to calculate the weighting coefficient $\alpha$ used in the similar filter $h_{R,R}$ for the direct acoustic paths to the right ear. However, for the filters $h_{L,R}$ and $h_{R,L}$ for the crossed paths, for example for the filter $h_{L,R}$ for the crossed paths to the left ear, the coefficient $\alpha=\alpha_2$ can preferably be written:

$$\alpha_2=abs(ICC_R),\ \text{if } abs(ICC_R)>\sigma_{BR}{}^{2},$$

$$\alpha_2=\sigma_{BR}{}^{2}\ \text{otherwise},$$

the term $\sigma_{BR}$ representing the target energy of the back right channel and the term $ICC_R$ representing the correlation between the front right channel and the back right channel. It will be noted that the "sqrt" function no longer applies for the crossed paths and for the calculation of the corresponding coefficient $\sigma_2$ in the described example. In fact, the target energies and the correlation indices are terms comprised between 0 and 1 such that the coefficient $\alpha_2$ is generally lower than the coefficient $\alpha_1$.

The combination of overall filters, for the L-BIN channel, comprises groupings of HRTF functions forming filters $h_{L,L}$ and $h_{L,R}$ obtained by the formulae given previously, and, in each grouping, the HRTF function of a front loud speaker, the HRTF function of a back loud speaker and a decorrelated version of this latter HRTF function are used, which makes it possible to represent a decorrelation between the front and back channels directly in the combination of filters, and therefore directly in the binaural synthesis.

It is recalled that, as the sound data L, R (or M) are compression-encoded in a transformed domain, the combination of filters can be applied directly in the transformed domain as a function of the target energies ($\sigma_{FL}$, $\sigma_{BL}$, $\sigma_{FR}$, $\sigma_{BR}$) associated with the channels of the multi-channel format, these target energies being determined from the spatialization parameters SPAT. In this embodiment, there is of course then provision for changing from the transformed domain to the temporal domain again for the actual restitution in the binaural context (the TRANS modules in FIGS. 6A and 6B).

The present invention also relates to a decoding module DECOD BIN such as shown by way of example in FIG. 7, for a spatialized restitution in three dimensions on two restitution channels L-BIN and R-BIN, and comprising in particular of the means of processing sound data (compressed channels L, optionally R, in stereophonic mode and the spatialization parameters SPAT) for the implementation of the method described above. These means can typically comprise:

an input E for receiving the compressed channels and the spatialization parameters, a working memory MEM and a processor PROC for constructing the combination of filters from the SPAT parameters and applying these combinations to the compressed channels L and R respectively, and an output S for delivering the compressed and filtered signals for a spatialized binaural restitution on the two restitution channels L-BIN and R-BIN respectively.

The present invention also relates to a computer program intended to be stored in a memory of a decoding module, such as the memory MEM of the module DECOD-BIN shown in FIG. 7, for a spatialized restitution in three dimensions on two restitution channels L-BIN and R-BIN. The program therefore comprises instructions for the execution of the method according to the invention and, in particular, for constructing the combinations of filters integrating the decorrelated versions as shown in FIGS. 6A and 6B described above. In this context, one or other of these figures can constitute a flowchart representing the algorithm with is the basis of the program.

The invention claimed is:

1. A method of processing sound data for a three-dimensional spatialized restitution on two restitution channels for the respective ears of a listener, the sound data being initially in a multi-channel format and then compression-encoded on a reduced number of channels, said multi-channel format consisting in providing more than two channels able to feed respective loud speakers, the method comprising the steps:

obtaining spatialization parameters with the compressed data on said reduced number of channels, for each restitution channel associated with an ear of the listener, forming, on the basis of said spatialization parameters, a combination of filters each representing transfer functions between that ear of the listener and loud speakers that could be fed by respective channels of the initial multi-channel format, said combination comprising at least one first grouping, forming a first filter, on the basis of the transfer function of a front loud speaker, the transfer function of a back loud speaker, and a version of the transfer function of the back loud speaker, representing a decorrelation between channels, and wherein the front and back loud speakers are situated on a same first side with respect to the listener, and applying the combination of filters associated with each restitution channel to the compressed data, wherein the method furthermore comprises the steps:

for each restitution channel associated with an ear of the listener, determining from said spatialization parameters at least one transfer function of a loud speaker behind the listener's ear and representing a decorrelation between the channels of the multi-channel format respectively associated with the back loud speaker and at least one loudspeaker-in front of the listener's ear, said decorrelation comprising applying to a signal input to the transfer function representing a decorrelation and broken down into frequency subbands a different phase shift in each of the subbands, combined with the addition of an overall delay to the signal, and for each restitution channel, integrating said transfer function representing a decorrelation in said combination of filters associated with this restitution channel.

2. The method according to claim 1, wherein, as the sound data is compression-encoded in a transformed domain, the combination of filters is applied in the transformed domain as a function of the target energies associated with the channels of the multi-channel format, these target energies being determined from said spatialization parameters.

3. The method according to claim 2, the transformed domain being the subbands domain, wherein the decorrelated versions of the HRTF functions of the back loud speakers are obtained by applying to the initial HRTF functions of the back loud speakers a phase shift which is a function of each frequency subband.

4. The method according to claim 1, wherein the compression-encoding uses a parametric encoder delivering a decorrelation between channels of the multi-channel format cue, and in that the weighting coefficient is represented by a function that is dynamically variable as a function of a decorrelation cue delivered by the parametric encoder.

5. The method according to claim 1, the sound data being compression-encoded on two channels, wherein the combination of filters associated with said restitution channel comprises, besides said first filter forming grouping of one of the compressed channels, a second filter forming grouping of the other one of the compressed channels on the basis of:

the transfer function of a front loud speaker situated on a second side, opposite to the first side with respect to the listener, the transfer function of a back loud speaker situated on said second side, and a version of the transfer function of this back loud speaker, representing a decorrelation between channels.

6. The method according to claim 1, wherein said transfer functions of the loud speakers are of the HRTF type and represent of the acoustic interference on the paths between each loud speaker and an ear for a restitution channel associated with that ear.

7. A decoding module for a spatialized restitution in three dimensions on two restitution channels, comprising a component configured to process sound data for the implementation of the method according to claim 1.

8. A non-transitory computer readable medium comprising code instructions for performing the method as claimed in claim 1.

* * * * *